US006923250B2

(12) United States Patent
Hegg et al.

(10) Patent No.: US 6,923,250 B2
(45) Date of Patent: Aug. 2, 2005

(54) LOUVER ASSEMBLY

(75) Inventors: Trevor H. Hegg, Westminster, MD (US); Thomas W. Bugler, III, Frederick, MD (US)

(73) Assignee: Evapco International, Inc., Wilmington, DE (US)

( * ) Notice: Subject to any disclaimer, the term of this patent is extended or adjusted under 35 U.S.C. 154(b) by 185 days.

(21) Appl. No.: 10/607,893

(22) Filed: Jun. 27, 2003

(65) Prior Publication Data

US 2005/0006798 A1 Jan. 13, 2005

(51) Int. Cl.[7] ..... F28B 3/00
(52) U.S. Cl. ..... 165/113; 165/110; 261/112.2
(58) Field of Search ..... 165/110, 113, 165/150–152; 62/515; 261/112.2

(56) References Cited

U.S. PATENT DOCUMENTS

| | | | | |
|---|---|---|---|---|
| 808,897 | A | | 1/1906 | Carrier |
| 2,231,088 | A | | 2/1941 | Richardson |
| 2,555,125 | A | | 5/1951 | Gregory |
| 3,216,708 | A | | 11/1965 | Ferry |
| 3,226,098 | A | | 12/1965 | Shryock |
| 3,260,511 | A | | 7/1966 | Greer |
| 3,332,335 | A | | 7/1967 | Hillstrom |
| 3,374,992 | A | | 3/1968 | Greer |
| 3,415,502 | A | | 12/1968 | Munters |
| 3,500,615 | A | | 3/1970 | Meek |
| 3,526,393 | A | * | 9/1970 | Meek ..... 261/102 |
| 3,628,442 | A | | 12/1971 | Nijhuis |
| 3,862,280 | A | * | 1/1975 | Polovina ..... 261/112.2 |
| 3,923,935 | A | | 12/1975 | Cates |
| 4,040,824 | A | | 8/1977 | Kinney, Jr. |
| 4,269,796 | A | | 5/1981 | Glicksman et al. |
| 4,333,749 | A | | 6/1982 | Holmberg et al. |
| 4,427,607 | A | | 1/1984 | Korsell |
| 4,452,024 | A | | 6/1984 | Sterriker et al. |
| 4,514,202 | A | | 4/1985 | Kinney, Jr. et al. |
| 4,548,766 | A | * | 10/1985 | Kinney et al. ..... 261/112.2 |
| 4,557,740 | A | | 12/1985 | Smith |
| 4,958,555 | A | | 9/1990 | Lentz et al. |
| 5,320,651 | A | | 6/1994 | Drummond |
| 5,601,485 | A | | 2/1997 | Gigola |
| 5,617,780 | A | | 4/1997 | Robbs |
| 6,251,499 | B1 | * | 6/2001 | Lehman et al. ..... 428/182 |
| 6,260,830 | B1 | | 7/2001 | Harrison et al. |
| 6,315,804 | B1 | | 11/2001 | Bradley |
| 2002/0195729 | A1 | | 12/2002 | Merrill et al. |

* cited by examiner

*Primary Examiner*—Terrell McKinnon
(74) *Attorney, Agent, or Firm*—Akin Gump Strauss Hauer & Feld, LLP

(57) ABSTRACT

A louver assembly is disclosed for use in a heat exchanger associated with a liquid basin. The louver assembly is made of a plurality of generally vertically oriented, non-corrugated sheets attached to adjacent corrugated sheets of material. Spaces between the corrugations and the non-corrugated sheets form air passageways extending downwardly through the louver assembly from an inlet face to an outlet face of the louver assembly. The corrugated and non-corrugated sheets have a V-shape in a top plan view defined by two acute angles X and Y on one surface of the sheets with respect to a transverse reference plane, resulting in a vertex angle Z on an opposite surface of the sheets of about 120° to about 140°. The V-shape of the sheets provides each of the corrugations and air passageways with a single inlet portion and a single outlet portion. The angle X is measured with respect to the intersection of a central vertical longitudinal reference plane and the transverse reference plane regarding the inlet portion. The angle Y is similarly measured regarding the outlet portion. The inlet portion and outlet portion extend at respective independent downwardly directed angles A1 and A2 of greater than 0° to about 10° The air passageways have a width such that a ratio of the depth of the louver assembly to the width of the air passageways is about 3:1 to about 6:1.

26 Claims, 4 Drawing Sheets

LOUVER ASSEMBLY

CROSS-REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

The present invention relates to a louver assembly for allowing air to pass through the assembly, while reducing the likelihood of drops or mist of water or other liquid passing out of the assembly, and also reducing the light passing through the assembly. More particularly, the louver assembly of the present invention is for use in a heat exchanger, such as a direct or indirect counter-flow or cross-flow cooling tower, a spray-filled tower, closed circuit cooler or an evaporative condenser, all of which are hereinafter categorically referred to as a "heat exchanger." The louver assembly of the present invention allows air to readily enter the heat exchanger, prevents or significantly reduces the amount of water or other liquid splashing out from the heat exchanger, and reduces the amount of light entering the heat exchanger to reduce or retard the growth of algae or other microorganisms present in a liquid basin within the heat exchanger and whose growth is promoted by light.

Many types of louvers are known for many purposes, including decorative purposes where they allow air to enter a building and shield the building from light and rain on the outside, for example. Louvers are also used with heat exchangers of the aforementioned types and for the aforementioned purposes.

The louver assembly of the present invention provides these functions in a way which does not adversely affect the efficiency of the heat exchanger. The efficiency of the heat exchanger remains substantially unaffected using the louver assembly of the present invention, even though the louver assembly of the present invention causes air to travel through the assembly in two different vertical planes and one downwardly angled transverse plane. The present invention also provides sound dampening. The components are easy to manufacture and are readily assembled. Thus, the present invention can be made at a reasonable cost.

BRIEF SUMMARY OF THE INVENTION

The present invention relates to a louver assembly for use in a heat exchange apparatus in an ambient environment, the heat exchange apparatus being associated with a liquid basin, the louver assembly having a height and comprising a plurality of generally vertically oriented, non-corrugated sheets of material, and a plurality of generally vertically oriented corrugated sheets of material having corrugations extending across the corrugated sheet and along the corrugated sheet for the entire height of the louver assembly, each non-corrugated sheet of material being retained adjacent to a corrugated sheet of material; spaces between the corrugations and the non-corrugated sheets forming air passageways extending downwardly through the louver assembly from an inlet face of the louver assembly adjacent the ambient environment to an outlet face of the louver assembly adjacent an interior of the heat exchange apparatus; the louver assembly having a width based on the dimensions of the sheets in a direction along the inlet face and the outlet face of the louver assembly and the number of non-corrugated sheets and corrugated sheets comprising the louver assembly; the louver assembly having a depth defined by the distance from the inlet face to the outlet face of the louver assembly; the louver assembly having a generally vertical longitudinal reference plane extending through a centerline along the louver assembly's width and a generally vertical transverse reference plane extending perpendicular to the longitudinal reference plane; each sheet of material having a V-shape in a top plan view of the louver assembly, the V-shape of the non-corrugated sheets and the corrugated sheets being defined by two acute angles X and Y on one surface of the sheets with respect to the transverse reference plane and resulting in a vertex angle Z on an opposite surface of the sheets, the vertex angle Z being about 120° to about 140°; the V-shape of the sheets providing each of the corrugations and air passageways with a single inlet portion extending from the inlet face of the louver assembly to the longitudinal reference plane and a single outlet portion extending from the longitudinal reference plane to the outlet face of the louver assembly; the angle X being measured with respect to the intersection of the longitudinal and transverse reference planes regarding the inlet portion and the angle Y being measured with respect to the intersection of the longitudinal and transverse reference planes regarding the outlet portion; the inlet portion having a downwardly directed angle A1 of greater than 0° to about 10° with respect to a horizontal reference plane measured from an intersection of the inlet face and the horizontal reference plane; the outlet portion having a downwardly directed angle A2 of greater than 0° to about 10° with respect to a horizontal reference plane measured from the intersection of the inlet face and the horizontal reference plane; and each of the air passageways having a width generally parallel to the longitudinal reference plane such that there is a ratio of the depth of the louver assembly to the width of each of the air passageways of about 3:1 to about 6:1.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 7:
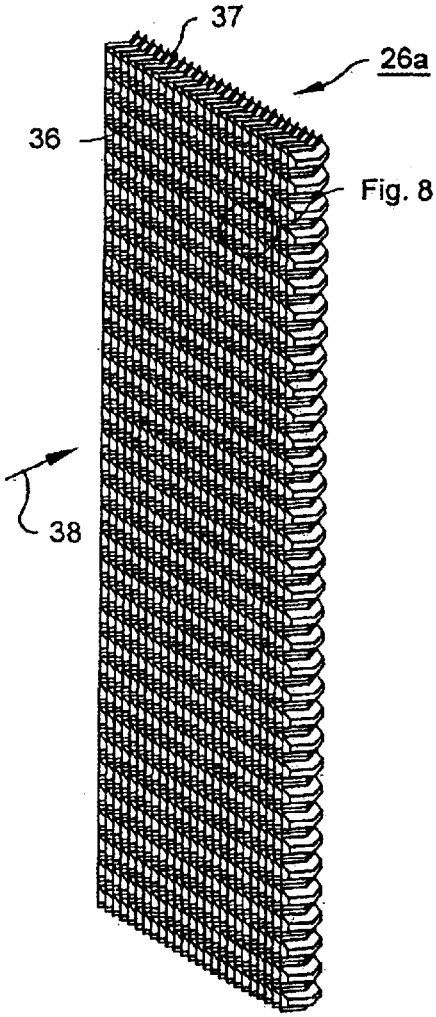
FIG. 7 is an isometric view of a second exemplary embodiment of a louver assembly according to the present invention.

Certain terminology may be used in the following description for convenience only and is not limiting. The words "front," "rear," "left," "right," "top" and "bottom" designate directions in the drawings to which reference is made, where the louver assemblies are oriented vertically in a heat exchanger as shown and described hereinafter with respect to FIG. 1, and as the louver assemblies are shown in FIGS. 2 and 7. The terminology includes the words specifically mentioned above, derivatives of such words and words of similar import. Furthermore, as used herein, the article "a" or "an" or a reference to a singular component includes the plural or more than one component, unless specifically and explicitly restricted to the singular or a single component, or unless otherwise clear from the context containing the term.

The invention will now be described in detail with reference to the drawings, wherein like numerals indicate like elements throughout the several views.

Figure 1:
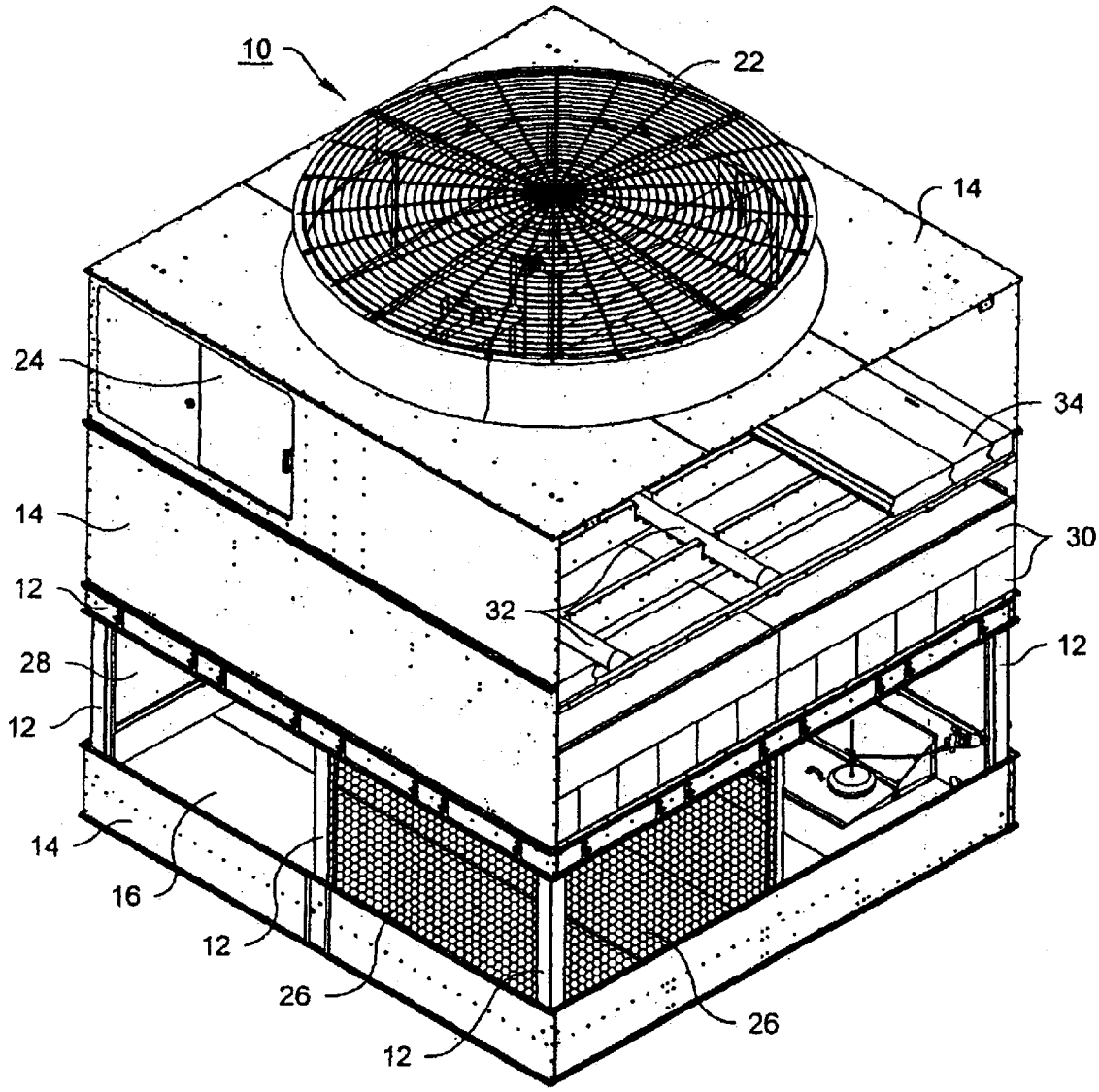
FIG. 1 is a schematic representation of one exemplary embodiment of a heat exchanger with which the louver assembly of the present invention may be used.
Figure 2:
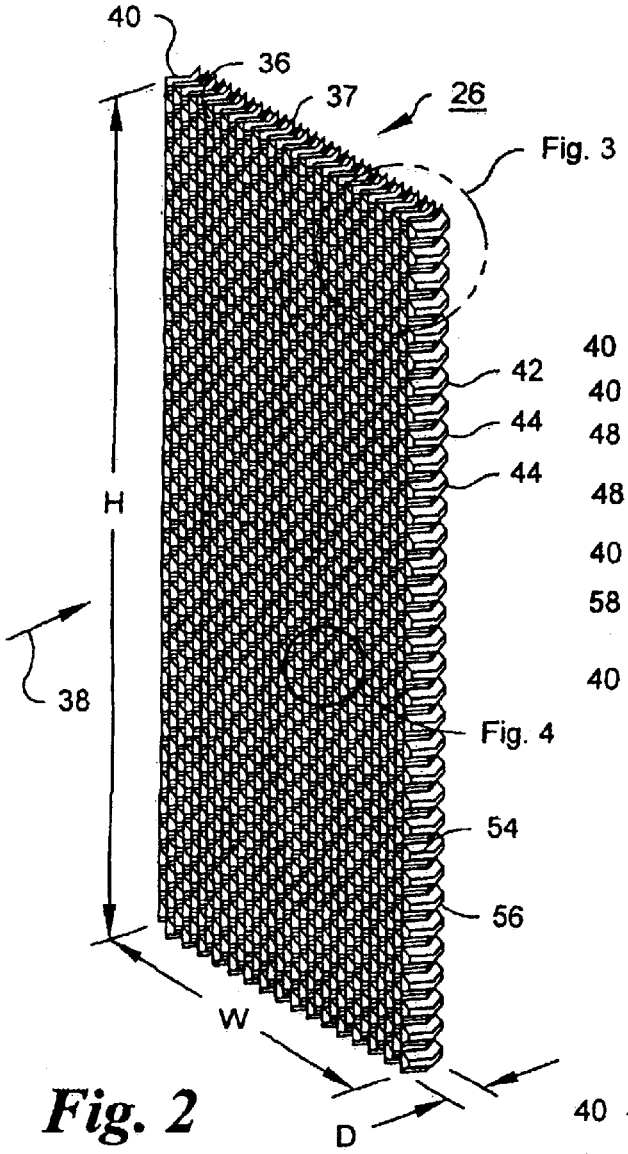
FIG. 2 is an isometric view of one exemplary embodiment of a louver assembly according to the present invention.

To help illustrate the environment in which the louver assemblies of the present invention are used, FIG. 1 shows one exemplary, non-limiting embodiment of a heat exchanger 10, in the form of an induced draft counter-flow cooling tower. This is only one example of a number of different types of cooling towers or other heat exchangers with which the louver assemblies of the present invention may be used. The heat exchanger 10 is in an ambient environment, where the term "ambient," as used herein, means any outdoor or indoor environment, and typically, but not exclusively, an outdoor environment, such as on the ground near or on the roof of an industrial, commercial or residential building. If desired, a heat exchanger may be located within a building with appropriate venting or ducting to the environment outside of the building.

The heat exchanger 10 includes a frame 12 to which are attached a number of housing cover panels 14, some of which have been omitted for clarity of illustration of the internal components. At the bottom of the cooling tower is a liquid basin 16, typically but not exclusively a water basin, since the typical liquid circulated through the cooling tower is water. The liquid basin is typically, as shown, located in the bottom portion of the cooling tower 10 or other heat exchanger, but the heat exchanger could be located above a separately formed liquid basin below the heat exchanger. In view of the latter arrangement, the present invention will be described as a louver assembly for use in a heat exchange apparatus associated with a liquid basin. There is a tendency for algae, bacteria and other microorganisms to grow in the water in the basin 16, as well as on other structures in the liquid environment within or associated with the cooling tower. One purpose of the louver assembly of the present invention is to block ambient sunlight from entering the interior of the heat exchanger 10 to minimize or at least reduce the growth of algae, bacteria and other microorganisms that may depend upon sunlight to enhance their growth. In an induced draft counter-flow cooling tower 10 shown in FIG. 1, a fan (not shown) is located under the fan grille 22. The fan is driven by an appropriate motor and associated drive elements (both not shown), typically located behind an access door 24 in the side of the housing cover panel or panels 14. The fan draws air into the cooling tower through a plurality of louver assemblies 26, only two of which are shown mounted in appropriate openings 28, typically, but not exclusively, in the lower portion of the cooling tower. When the air passes through the louver assemblies 26, it then travels through a plurality of air and water contact bodies in the form of wet deck fill 30. Two layers of wet deck fill 30 are shown in FIG. 1. In the wet deck fill, water or other liquid that is sprayed from a series of spray pipes 32 over the wet deck fill is cooled by evaporative cooling due to contact of the air and liquid in the wet deck fill. In this type of cooling tower 10, the water pours over the wet deck fill in a direction opposite (namely, counter) to the flow of the air. As the air and water meet, heat is transferred from the higher temperature of water or other liquid to the lower temperature air through the evaporative cooling process, causing the temperature of the water to decrease and the wet-bulb temperature of the air to increase. Water drains from the wet deck fill into the basin 16. Typically, the water or other liquid is recycled from the basin 16 to the spray pipes 32.

After the air is mixed with the liquid in the wet deck fill 30, the air tends to entrain some of the liquid which is not retained in the wet deck fill or which is not drained into the basin 16. The air with the entrained liquid is then drawn upwardly through drift eliminators 34, sometimes called mist eliminators, which help separate much of the liquid droplets from the air. After the air passes through the drift eliminators 34, the air exits from the cooling tower, typically through the top portion of the heat exchanger.

The louver assembly 26 of the present invention must allow air to be drawn into the cooling tower 10 or other heat exchanger in a pathway that is as unimpeded as possible to avoid additional power requirements for the motor and fan and to retain as much cooling efficiency as possible. However, the louver assembly also has to prevent or at least impede and reduce the escape of water or other cooling liquid from exiting the heat exchanger, which occurs when the liquid splashes into liquid already contained in the basin 16, or when liquid drains from the wet deck fill 30. This is also referred to as "splash out." As mentioned above, another function of the louver assembly of this invention is to block, restrict or at least reduce the amount of light entering into the heat exchanger from the ambient environment. The functions of allowing relatively unimpeded air flow through the louver assemblies, on the one hand, and the restricted escape or splashing out of liquid out of the louver assemblies, and the reduction of light into the heat exchanger, on the other hand, are at odds with each other. The reduction of splash out from the heat exchanger and the reduction of light entering the heat exchanger are typically accomplished by convoluted pathways, which tend to adversely affect air flow into the heat exchanger through the louver assemblies. This tends to cause a pressure drop increase that adversely affects thermal efficiency and performance of the heat exchanger. Moreover, the use of a louver assembly that also helps to reduce or dampen sound from the heat exchanger, again typically by providing a convoluted pathway through the louver assembly, is also a benefit in general and is another advantage of the louver assembly of the present invention. Thus, it is a delicate balance that must be achieved to allow sufficient air passage into the heat exchanger through the louver assembly, while restricting the amount of light entering the heat exchanger and the amount of liquid and sound leaving the heat exchanger. The present invention has achieved an effective balance by which liquid is retained in the heat exchanger, light is largely excluded from the heat exchanger and sound from within the heat exchanger is also baffled by the louver assembly.

Figure 3:
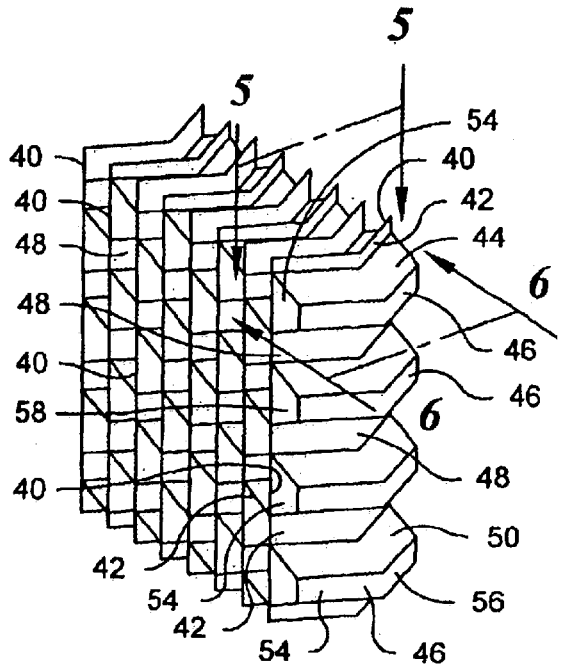
FIG. 3 is an enlarged isometric view of a portion of the louver assembly designated as "FIG. 3" in FIG. 2.
Figure 4:
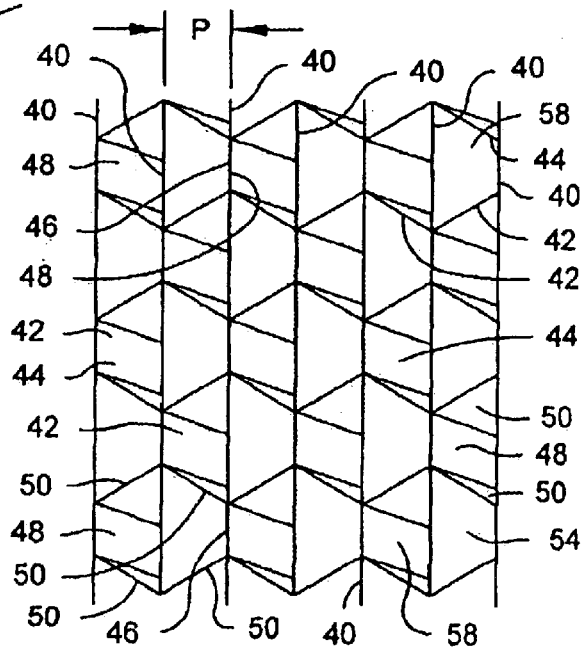
FIG. 4 is an enlarged front elevation view of a portion of the louver assembly designated as "FIG. 4" in FIG. 2 when viewed in a direction perpendicular to the front or inlet face of the louver assembly.
Figure 5:
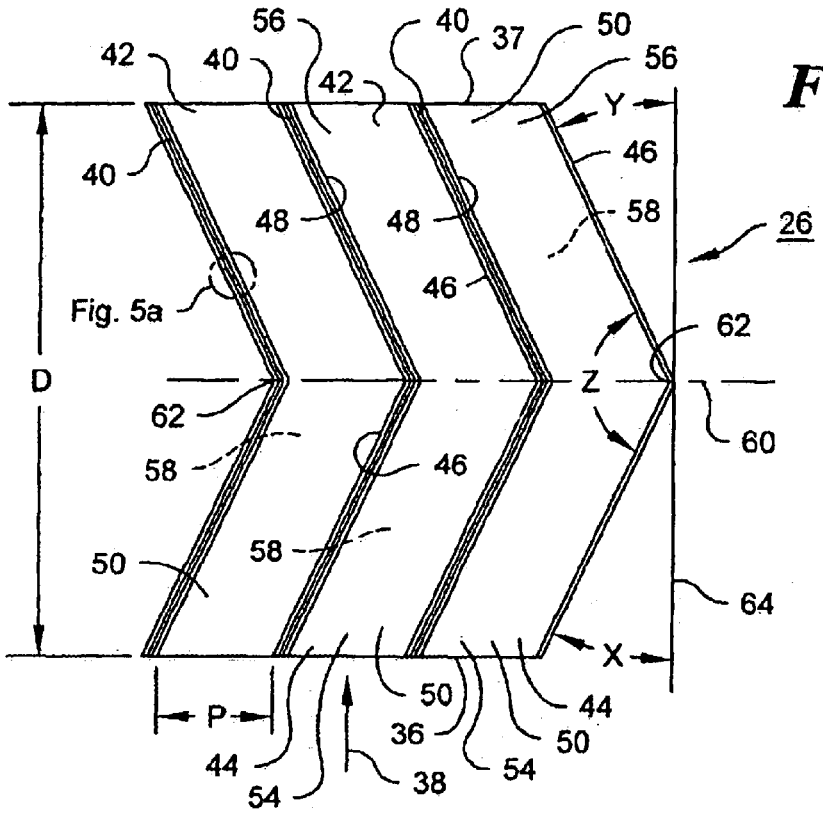
FIG. 5 is a top plan view of a portion of the embodiment of the louver assembly of FIG. 2, taken along the lines 5—5 in FIG. 3.
Figure 6:
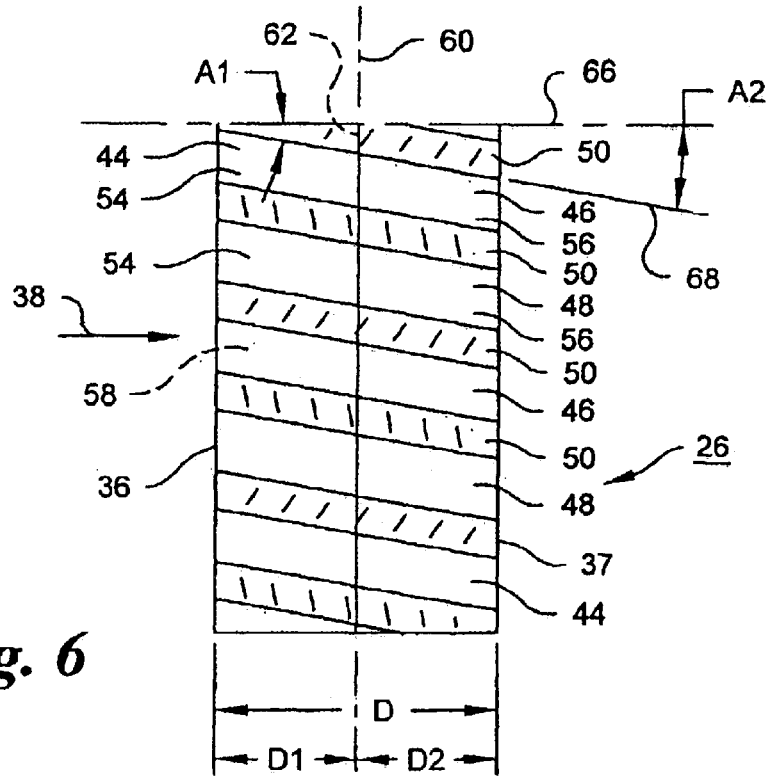
FIG. 6 is a right end elevation view of a portion of the embodiment of the louver assembly of the present invention shown in FIG. 2, taken along lines 6—6 of FIG. 3.
Figure 8:
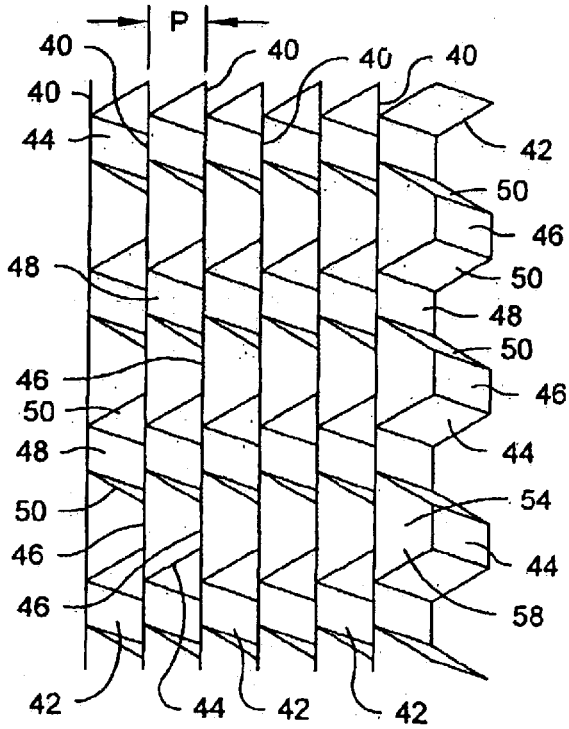
FIG. 8 is an enlarged front elevation view of a portion of the embodiment of the louver assembly of FIG. 7 as designated by "FIG. 8" in FIG. 7 when viewed in a direction perpendicular to the front or inlet face of the louver assembly.

One embodiment of a louver assembly 26 according to the present invention will now be described primarily with reference to FIGS. 2 through 6. Another embodiment of a louver assembly 26*a* of the present invention is illustrated in FIGS. 7 and 8. FIGS. 5 and 6 apply to both embodiments 26 and 26*a* of the present invention. The primary distinction between the louver assembly 26 and the louver assembly 26*a* is best seen by comparing FIGS. 4 and 8, showing a different arrangement of certain corrugated sheets, as described below.

In use, the louver assemblies 26 and 26*a* are installed in a generally vertical direction within the frame 12 or otherwise within at least one wall of a heat exchanger. When the word "generally" is used herein with directional words, such as "vertical," "horizontal," "parallel," or "perpendicular," for example, "generally" means that the component being described with reference to the particular direction is preferably but not necessarily in the exact direction, but may have a variation from the indicated direction, up to about 10°. The louver assembly is used in a generally vertical direction to provide the appropriate drainage of water or other liquid back into the heat exchanger with which it is used or the associated liquid basin, and to provide appropriately oriented passageways for air to travel through the louver assembly so as not to adversely affect horsepower requirements for driving the fan and thermal efficiency.

As indicated in FIG. 2, for clarity in description and explanation, the louver assembly 26 is shown ads having a height H, a width W and a thickness or depth D, with an end that can be arbitrarily designated as the right end at the right-hand side portion of the figure, and with an air inlet face 36 adjacent the ambient environment illustrated as facing the viewer and that can be arbitrarily designated as the front of the louver assembly. An air outlet face 37 of the louver assembly 26, not visible in FIG. 2, is generally parallel to the air inlet face 36 and is adjacent the interior of the heat exchanger. The air outlet face can be arbitrarily designated as the rear of the louver assembly. The height H, and the width W of the louver assembly are determined by the height and width, respectively, of louver frame assembly openings 28 in the heat exchanger 10. The dimensions of the louver frame openings 28, and therefore, the louver assemblies 26 fitting within the openings 28, are based on the thermal performance requirements of the heat exchanger with which the louver assemblies are used. The width W is measured in a direction along and generally parallel to the inlet face 36 and the outlet face 37 of the louver assembly, and is determined by the number of non-corrugated sheets and corrugated sheets used to make the louver assembly that are needed to fit within the louver frame openings 28. The depth D, also shown in FIGS. 5 and 6 for ease in orientation, is the distance between the air inlet face 36 and the air outlet face 37. The height H, width W and depth D relationships described above for the louver assembly 26 also apply to the other embodiment of the louver assembly 26*a*, even though FIG. 7 is not labeled with H, W or D. Directional arrows 38 in FIGS. 2, 5, 6 and 7 are used to generally indicate the direction of air approaching and flowing through the louver assemblies 26 and 26*a* in a direction generally perpendicular to the air inlet face 36 of the louver assemblies 26 and 26*a*.

The louver assemblies 26 and 26*a* comprise a plurality of generally vertically oriented, non-corrugated sheets 40 of material and a plurality of generally vertically oriented corrugated sheets 42 of material. Each non-corrugated sheet 40 should be retained against a corrugated sheet 42. However, as illustrated in FIGS. 2, and 3, if desired, one end, say the right end, need not end with a non-corrugated sheet 40. Similarly, the opposite end, say the left end, need not end with a corrugated sheet 42. Otherwise, the non-corrugated sheets 40 alternate with adjacent corrugated sheets 42 throughout the louver assembly 26 or 26*a*. It is preferred that the non-corrugated sheets 40 and the corrugated sheets 42 be attached to each other, such as by adhesive or other type of chemical or fusion bond, as explained below, or by a mechanical fastening associated with both types of sheets, such as mechanically interlocked portions. However, the sheets need only be retained against each other in a sufficiently tight manner so as not to flutter or otherwise adversely affect the air flowing though the louver assembly when the heat exchanger with which it is used is in operation. This may be done by mechanically strapping the sheets together, by placing them within a separate frame before inserting them in the framework openings 28, or even tightly packing the sheets within the openings 28 in a manual operation in the field.

Each of the corrugated sheets 42 has a plurality of corrugations 44, with each corrugation 44 comprising a peak 46 or a valley 48 connected by corrugation walls 50 as best seen in FIGS. 3, 4 and 8. Of course, whether a corrugation is designated a peak or a valley depends upon a viewer's orientation. As used herein, a peak 46 extends towards the right end of the louver assembly 26 or 26*a* as shown in the orientation of FIGS. 2 and 7, and a valley 48 extends towards the left end of the louver assembly 26 or 26*a* as shown in the orientation of FIGS. 2 and 7.

Figure 5A:
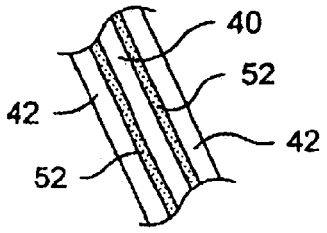
FIG. 5*a* is an enlarged top plan view of a portion of the louver assembly designated as "FIG. 5*a*" in FIG. 5

FIG. 5, a top plan view of a portion of the louver assembly 26 taken along lines 5—5 of FIG. 3, which would be the same for the embodiment of the louver assembly 26*a*, and FIG. 5*a*, an enlarged view designated "FIG. 5*a*" in FIG. 5, best illustrate one exemplary type of adhesive bonding of the non-corrugated sheets 40 and corrugated sheets 42. The exemplary embodiment of the bonding in FIGS. 5 and 5*a* shows the use of an adhesive 52 between the non-corrugated sheets 40 and peaks 46 and valleys 48 of adjacent corrugated sheets 42.

Each corrugation 44 includes a single inlet portion 54 extending from the inlet face 36 of the louver assembly 26 or 26*a* to a vertical longitudinal reference plane 60 described below, and a single outlet portion 56 extending from the vertical longitudinal reference plane 60 to the outlet face 37 of the louver assembly 26 or 26*a*. No lips, extensions or flanges at different angles are unitarily a part of or attached to the inlet portion 54 or the outlet portion 56. These would tend to adversely affect air flow through the louver assemblies. An air passageway 58 in the space between each corrugation 44 of the corrugated sheet 42 and the facing surface of the non-corrugated sheet 40 extending from the inlet face 36 to the outlet face 37 of the louver assembly 26 or 26*a* is formed only by the inlet portion 54 and the outlet portion 56, without any additional intermediate portion. The air passageways 58 have a width P as best shown in FIGS. 4, 5 and 8 in a direction corresponding to the width W of the louver assembly 26 or 26*a*. The air passageways 58 do not and should not contain any obstructions, such as lips, flanges, extensions, troughs or traps, that may be used to capture water or other liquid and prevent it from passing through the louver assemblies 26 or 26*a* from the outlet face 37 to the inlet face 36 of the louver assemblies. These obstructions, while potentially helpful in reducing splash out, also tend to adversely affect air flow through the louver assemblies 26 or 26*a* from the inlet face 36 to the outlet face 37 of the louver assemblies.

A vertical longitudinal reference plane 60, extending vertically and longitudinally through the center of the louver assembly 26, through vertices 62 of the angled sheets 40 and 42, substantially parallel to both the inlet face 36 and the outlet face 37 of the louver assembly 26, is shown in FIGS. 5 and 6, only for purposes of reference and clarity of explanation. A vertical transverse reference plane 64, perpendicular to the longitudinal reference plane 60, is also shown in FIG. 5, again only for purposes of reference and clarity of explanation. A horizontal reference plane 66 is shown in FIG. 6, a partial right end elevation view of the louver assembly 26 taken along lines 6—6 of FIG. 3. As with the reference planes 60 and 64, the horizontal reference plane 66 is only for the purposes of reference and clarity of explanation. By way of example, the width P of the air passageways 58 is measured in a direction generally parallel to the longitudinal reference plane 60. Additionally, the longitudinal reference plane 60 is the dividing plane between the inlet portion 54 and the outlet portion 56 of the corrugations 44 and the air passageways 58.

As best seen in FIGS. 2, 3, 5 and 7, the non-corrugated sheets 40 and the corrugated sheets 42 have a V-shape in a top plan view of the louver assembly. The V-shape is defined by two acute angles X and Y on one surface of the sheets with respect to the transverse reference plane 64. This results in a vertex angle Z on an opposite surface of the sheets with respect to the vertex 62. The angle X is measured with respect to the intersection of the longitudinal reference plane 60 and the transverse reference plane 64 regarding the inlet portion 54 of the corrugation 44 and the associated air passageway 58. The angle Y is measured with respect to the intersection of the longitudinal reference plane 60 and the transverse reference plane 64 regarding the outlet portion 56 of the corrugation 44 and the associated air passageway 58. The vertex angle Z is about 120° to about 140°, regardless of whether angles X and Y are substantially equal to each other or not, with each of angles X and Y independently being about 20° to about 30° with respect to the transverse plane 64. As used herein with respect to any numerical value, the term "about" means the value indicated plus or minus 10% of the value. Preferably, the vertex angle Z is about 130°, again whether or not angles X and Y are substantially equal to each other. More preferably, each of angles X and Y is preferably about 25°. When angles X and Y are not substantially equal to each other, it is preferred that the angle X be greater than the angle Y within the range indicated above, since this relationship is believed to provide fore a better air flow through the louver assembly with less pressure drop, and thus a better thermal performance.

The inlet portion 54 of the corrugations 44 and air passageways 58 has a depth from the inlet face 36 to the longitudinal reference plane 60, and the outlet portion 56 has a depth from the longitudinal reference plane 60 to the outlet face 37. As shown in the drawings, and particularly in FIGS. 5 and 6, in a preferred embodiment of the louver assembly of the present invention, the depth of the inlet portion 54 is about equal to the depth of the outlet portion 56. However, if desired, the depth of the inlet portion 54 may be greater than or less than the depth of the outlet portion 56. When determining the relative depths of the inlet portion 54 and the outlet portion 56, consideration should be given to maintaining a blocked line of sight to prevent or minimize light traveling through the louver assembly into the heat exchanger, the effect on splash out of water or other liquid from the basin 16 out through the louver assembly, the effect on sound reduction, and the effect on air flow through the louver assembly into the heat exchanger with the resulting effect on power requirements and thermal efficiency. These effects can be determined readily and empirically by a person skilled in this technology in view of the present disclosure, without undue experimentation.

With reference to FIG. 6, the corrugations 44 are shown to be angled downwardly from the inlet face 36 to the outlet face 37 of the louver assembly 26 or 26*a* with respect to the horizontal reference plane 66. The downward angle is based on a downward angle A1 of the inlet portion 54 and a downward angle A2 of the outlet portion 56. Thus, the inlet portion 54 slopes downwardly at the angle A1 from the inlet face 36 to the longitudinal reference plane 60, and the outlet portion 56 slopes downwardly at the angle A2 from the longitudinal reference plane 60 to the outlet face 37 of the louver assembly 26. Both downwardly directed angles A1 and A2 are measured along a transverse axis or axes 68 of the corrugations 44 from an intersection of the inlet face 36 and the horizontal reference plane 66.

Each of downward angles A1 and A2 independently may be any angle greater than 0° to about 10° with respect to the horizontal reference plane measured from the intersection of the inlet face and the horizontal reference plane. Preferably, each of the downward angles A1 and A2 independently is about 5° to about 10°, and more preferably, about 10°. The downward angle allows water or other liquid that may splash from a basin, such as basin 16 of the heat exchanger 10, to drain back into the basin. A downward angle of up to about 10° is also beneficial in reducing the amount of sunlight in a direct line from the sun, except perhaps during sunrise and sunset, from penetrating far into the air passageways 58 of the louver assembly. The relatively small downward angle is also important in that it tends not to significantly impede the air flow from the direction 38 through the louver assembly. This helps maintain the thermal efficiency of the heat exchanger using the louver assemblies of the present invention.

As shown in FIG. 6, the angles A1 and A2 are about equal to each other, such that the angles A1 and A2 meld together and form one continuous downward angle. This is an example of a preferred embodiment, where the air flow through the air passageways 58 is least impeded, as the air passageways are the least convoluted. The countervailing consideration is that the line of sight and pathway for drops or mist of water or other liquid also are straighter, resulting in a potentially easier pathway into and out of the heat exchanger respectively, for light outside of the heat exchanger and liquid inside the heat exchanger. If desired, the downward angle A1 may be greater than or less than the downward angle A2, which would result in the corrugations 44 having a compound downward angle. This provides a more convoluted pathway beneficial for preventing or reducing light, sound and drops or mist of water or other liquid traveling through the air passageway 58, but also provides a more convoluted pathway for air entering the heat exchanger through the louver assemblies that may increase the power requirements and decrease the thermal efficiency of the heat exchanger. A balance is needed and can be determined readily by a person skilled in this technology on an empirical basis without undue experimentation in view of the present disclosure.

Each of the corrugations 44, comprising a peak 46 or a valley 48, may have any desired vertical cross-section shape. The presently preferred shape is a trapezoid where the peak 46 or the valley 48 is fairly tall between the adjoining corrugation walls 50. Using tail peaks and valleys allows the ready application of sufficient adhesive, solvent, etc., to have a firm attachment of the corrugated sheets 42 to the non-corrugated sheets 40, where such chemical bonding is chosen to retain the sheets against each other. Although a trapezoidal vertical cross-section is preferred for the corrugations 40, the corrugations could have any other desired shape, based on the application and thermal performance requirements of a louver assembly for a particular type of heat exchanger and a particular application. Appropriate shapes include a triangular vertical cross-section, a curved or sinusoidal vertical cross-section, or a rectangular vertical cross-section, for example, and not by way of limitation. The shape and size of the vertical cross-section for the corrugations 44, and therefore, also the shape and size of the air passageways 58, may be determined readily by a person ordinarily skilled in this technology, in view of the present disclosure. As will be apparent hereinafter, it is important to maintain the proper relationship between the width P of the air passageway and the depth D of the louver assembly, to the downward angles A1 and A2, and to the vertex angle Z.

The performance of the heat exchanger with which the louver assemblies of the present invention are used is significantly affected by the relationship, dimensions and angles of the components of the louver assemblies. In addition, these aspects are important in blocking light entering into the heat exchanger and reducing the sound and amount of water or other liquid escaping from the heat exchanger. Thus, for example, to maintain a closed line of sight through the air passageways 58 of the louver assemblies, the vertex angle Z should be 120° to 140°, and preferably, 130°. To reduce the line of sight and, therefore, the amount of light passing through the louver assemblies, to decrease the likelihood that water or other liquid will escape through the louver to the ambient environment, and to best dampen the sound leaving the heat exchanger, it is preferred to have the smallest possible vertex angle Z. However, the light and sound reduction and splash-out benefits of such a small angle for the vertex angle Z must be balanced against adverse air flow considerations, resulting in a greater pressure drop and reduced thermal efficiency of the heat exchanger with which the louver assemblies are used, when there is a small vertex angle Z. The lowest pressure drop and greatest thermal efficiency occurs using the largest possible vertex angle Z. Thus, a delicate balance is necessary.

Light and sound reduction, splash-out and pressure drop are also affected by the depth D of the louver assemblies, with greater depths being favored for purposes of light and sound reduction and splash-out reduction. The relative depth of the inlet portion 54 to the outlet portion 56 is also a consideration, as discussed above. These must be balanced against the increased pressure drop and lower thermal efficiency, as well as increased material costs and shipping costs associated with louver assemblies of greater depth. The depth D of the louver assemblies 26 and 26*a* of the present invention should be about 1.75 inches (4.4 cm) to about 8.25 inches (21.0 cm). Preferably, the depth D of the louver assembly is about 2.8 inches (7.1 cm) to about 3.6 inches (9.1 cm). More preferably, the depth D of the louver assembly is about 3.2 inches (8.1 cm). If the vertex angle Z is at a greater extent of its range, then the depth D of the louver assembly also should be at the greater extent of its range, so as to maintain a blocked line of sight though the air passageways 58 and through the louver assemblies 26 or 26*a*.

The width P of the air passageways 58 is also an important factor with respect to the functions of light and sound reduction, splash-out and pressure drop with the associated effect on thermal efficiency with respect to the use of the louver assemblies 26 and 26*a* of the present invention. In addition, louver assemblies with air passageways 58 having a greater width P have increased material and shipping costs compared with those where the width P is not as great. As with the other parameters discussed above, there is a tradeoff in effectiveness with respect to the light reduction and splash-out reduction on the one hand, and the pressure drop and associated decrease in thermal efficiency, on the other hand, concerning the width P of the air passageways 58. The line of sight is reduced the most, and therefore, the light reduction is the most, and also, the sound and the splash-out of liquid from the basin of the heat exchanger is reduced the most when the width P of the air passageways 58 is the least. However, in this instance, the pressure drop and thermal efficiency are also more adversely affected. Conversely, the air pressure drop is minimized and the thermal efficiency is enhanced most when the width P of the air passageways 58 is the greatest, but this tends to adversely affect light and sound reduction and splash-out reduction. Thus, again, a balance is necessary. The width P of an air passageway 58 should be about 0.5 inch (1.3 cm) to about 1.5 inches (3.8 cm), preferably about 0.65 inch (1.7 cm) to about 1.0 inch (2.5 cm), and more preferably about 0.75 inch (1.9 cm).

The inventors have determined that the parameters of louver depth D to the air passageway width P should be in a ratio of about 3:1 to about 6:1 to best balance the desired performance characteristics of good light and sound reduction, splash-out reduction and acceptable pressure drop through the louver assemblies 26 and 26*a* of the present invention, together with a vertex angle Z of about 120° to about 140°. Preferably, the ratio of the depth D of the louver assembly to the width P of the air passageway 58 is about 3.5:1 to about 5.5:1, and more preferably, the ratio of the depth D of the louver assembly to the width P of the air passageway is about 4.3:1.

Taking into account the appropriate balance of all of the parameters mentioned above a preferred louver assembly has a vertex angle of 120° to about 140°, an angle X of about 20° to about 30°, an angle Y of about 20° to about 30°, with the angle X substantially equal to or greater than the angle Y, and further, each of angles A1 and A2 independently of about 5° to about 10°, a depth D of the louver assembly of about 1.75 inches (4.4 cm) to about 8.25 inches (21.0 cm), a width P of an air passageway of about 0.5 inch (1.3 cm) to about 1.5 inches (3.8 cm), and a ratio of the depth D of the louver assembly to the width P of an air passageway of about 3:1, to about 6:1.

A more preferred louver assembly according to the present invention has a vertex angle Z of about 120° to about 140°, substantially equal angles X and Y of about 20° to about 30°, angles A1 and A2 independently, and preferably equally, of about 5° to about 10°, a depth D of the louver assembly of about 2.8 inches (7.1 cm) to about 3.6 inches (9.1 cm), an air passageway width P of about 0.65 inch (1.7 cm) to about 1.0 inch (2.5 cm) and a ratio of the depth D of the louver assembly to the width P of the air, passageway of about 3.5:1 to about 5.5:1.

An even more preferred louver assembly 26 or 26*a* of the present invention has a vertex angle Z of about 130°, angles X and Y each about 25°, angles A1 and A2 equally of about 10°, a louver assembly depth D of about 3.2 inches (8.1 cm), with the inlet portion 54 and the outlet portion 56 being about equal in depth, an air passageway width P of about 0.75 inch (1.9 cm) and a ratio of the depth D of the louver assembly to the width P of the air passageway of about 4.3:1.

One preferred embodiment of the present invention has a corrugated sheet 42 having corrugations 44 with a trapezoidal vertical cross-section best illustrated in FIGS. 4 and 8. Presently preferred exemplary, but non-limiting, dimensions for the vertical cross-section of the trapezoidal corrugations are where the peaks 46 and valleys 48 each have a height of about 0.66 inch (1.7 cm), the corrugations walls have a width of about 0.87 inch (2.2 cm), a base (distance between the beginning of a peak or a valley) has a dimension of about 1.53 inches (3.9 cm), and wall angles are about 60° with respect to the base.

As illustrated in FIG. 4, the louver assembly 26 may have the corrugated sheets 42 aligned in a pattern compared to the next adjacent corrugated sheet 42 such that the corrugations 44 ate 180° out of phase. In other words, the peaks 46 of one corrugated sheet 42 are aligned directly oppositely the valleys of an adjacent corrugated sheet 42, both corrugated sheets being attached to opposite sides of a non-corrugated sheet 40. This alignment provides a very strong honeycomb-shaped structure when viewed from the side as illustrated in FIG. 4.

FIGS. 7 and 8 illustrate an alternative alignment of the corrugated sheets with respect to each other in the illustrated embodiment of the louver assembly 26*a*. In the arrangement used in the louver assembly 26*a*, the peaks 46 of adjacent corrugated sheets 42 that are bonded or otherwise attached on opposite sides of the non-corrugated sheets 40 are all in alignment with each other. Correspondingly in this embodiment, the valleys 48 of the corrugated sheets 42 are aligned with each other, as well. This arrangement may be viewed as one in which the corrugations 44 are in phase with each other.

The non-corrugated sheets 40 and the corrugated sheets 42 may be made from the same or different materials, and may be selected from a variety of materials, for example, thermoplastic synthetic, polymers, such as polyvinylchloride, polystyrene, acrylonitrile-butadiene-styrene, polypropylene, etc.; metals such as galvanized or stainless steel, aluminum, copper or the like; materials such as cellulose; or alloys of thermoplastic materials, such as alloys of polyvinylchloride with other thermoplastic materials; composite materials such as fibrous cellulosic stock impregnated with a thermoplastic resin or the like.

Examples of other synthetic polymers and engineering resins which may be used include acetals, nylons, polyphenylene oxides, polycarbonates, polyether sulfones, polyaryl sulfones, polyethylene terephthalates, polyetherketones, polypropylenes, polysilicones, polyphenylene sulfides, polyionomers, polyepoxies, polyvinylidene halides, and the like. As will be recognized by those skilled in the art, in view of the present disclosure, the choice of a particular material is dictated by the application conditions. The presently preferred type of material is a synthetic polymer, and specifically, polyvinylchloride.

The sheets 40 and 42 may be manufactured by any conventional technique that is appropriate for the material selected. For example, when the sheets are to be manufactured from flat stock material of a thermoplastic synthetic polymer such as unplasticized polyvinylchloride, the individual louver assembly sheets may be thermally formed by a process such as thermoforming, pressure forming, vacuum forming, molding, hot stamping, or the like. For efficiency of manufacturing, two or more of each of the sheets corresponding to sheets unitarily formed for later separation into sheets or assemblies of appropriate depth and height, may be made at the same time. The large, multi-unit sheets may then be cut to form sheets of appropriate dimensions to be formed into the louver assemblies. It is more efficient if such multi-unit sheets are assembled into multi-unit louver assemblies, such as by chemically bonding or mechanically retaining the non-corrugated sheets 40 and the corrugated sheets 42 in the alternating adjacent arrangement explained above in sufficient numbers to fill the width of the louver assembly framework openings 28, and then cutting the multi-unit louver assemblies of any given depth and any given height to fit the openings 28, for example with a band saw, table saw or the like.

Where the louver assemblies are formed by retaining the sheets 40 and 42 adjacent and against each other by techniques other than by mechanical fastening, retaining them within a frame, strapping, or the like, attachment by bonding the non-corrugated sheets 40 to the corrugated sheets 42 may be accomplished by any number of different types of bonds, including solvent bonds, adhesive bonds and fusion bonds, all of the above being preferred when the sheets are made of synthetic polymers. Appropriate solvents and adhesives are well known to those skilled in the art in view of the present disclosure, based upon the type of material used to make the sheets. Fusion bonds may be accomplished by direct application of heat using appropriately shaped heated platens, or indirectly by ultrasonic bonding or radio frequency bonding. If the sheets are made of metal, adhesive bonding or welding, at least along some or most, and preferably all, of the peaks 46 and valleys 48 to join the corrugated sheets 42 to the non-corrugated sheets 40, can bond the sheets together in an effective manner.

Any number of sheets can be assembled together to form louver assemblies according to the present invention. The dimensions of the individual sheets can be varied depending upon the application of the louver assembly and any particular setting within the parameters disclosed herein.

EXAMPLES

Tests were performed on a prototype of the embodiment of the louver assembly 26*a* best shown in FIGS. 7 and 8, where the configuration of the corrugations 44 is such that the peaks 46 of adjacent corrugated sheets 42 are in alignment with each other and the valleys 48 of adjacent corrugated sheets 42 are also in alignment with each other; thus, the peaks are in phase with each other and the valleys are in phase with each other. The louver assembly 26*a* was tested in an induced draft counter-flow cooling tower of a type generally illustrated in FIG. 1.

Also tested in the same cooling tower for comparison purposes was a conventional louver assembly comprising a plurality of interposed flat and corrugated sheets bonded to each other. In a top plan view, there is no V-shape, but rather, the non-corrugated sheets extend substantially across the depth of the louver assembly, from the inlet side to the outlet side. The conventional louver has a depth of about 2.5 inch (6.35 cm). The corrugations of the corrugated sheets form air passageways and have a short (about 0.5 inch (1.3 cm)), substantially horizontal inlet portion, an intermediate portion angled downwardly about 45° from the inlet section, and a short, substantially horizontal outlet portion extending from the bottom of the intermediate portion for about 0.5 inch (1.3 cm). The corrugations are trapezoidal, with each of the peaks and valleys of the inlet and outlet portions having a height of about 0.6 inch (1.5 cm), a base of about 1.1 inches (2.8 cm), with corrugation walls having a width of about 1 inch (2.5 cm) and base angles of the corrugation walls of about 77°. The corrugations form air passageways having a width (corresponding to the width P of the air passageways 58 of the present invention) of about 1 inch (2.5 cm). The intermediate portion of the corrugations have a cross-section that is shorter in height than those of the inlet sections and outlet sections, and have a trapezoidal cross-sectional shape with peaks and valleys of about 0.5 inch (1.3 cm), a base of about 0.8 inch (2.0 cm), base angles of about 77°, and a width of about 1 inch (2.5 cm). Based on the dimensions and angles of the conventional louver assembly set forth above, the ratio of the depth of the conventional louver assembly to the width of the air passageways is about 2.5. There is an open line of sight directly through the conventional louver, when looking through the conventional louver assembly at a downward angle of about 45°. This is in contrast to a blocked line of sight when trying to look through the louver assembly of the present invention at any angle.

Example 1

The first test conducted was a visual comparison of the splash-out between the louver assembly of the present invention and the conventional louver assembly. Brown paper was laid on the ground around multiple sides of a cooling tower. Water was recirculated through the tower without the fan operating, which enables the highest splash-out rates, since the water does not have to travel through the resistance provided by air coming into the cooling tower through the louver assemblies. First, conventional louver assemblies were tested, and then the conventional louvers were replaced with louvers of the present invention and all test parameters were repeated in the same manner. Water that splashed out of the cooling tower was clearly visible on the brown paper with a high contrast. Photographs were taken to make a visual record of the splash-out resulting from the use of the louver assemblies of the present invention compared to conventional louver assemblies. Based on the splash-out of the water on the brown paper, the use of louver assemblies of the present invention resulted in a drastic reduction in splash-out of water from the cooling tower basin.

Example 2

Experiments were performed to determine thermal capacity, energy consumption and pressure drop. In each test, ambient pressure was measured outside of the heat exchanger, and pressures were measured below the level of the wet deck fill 30 after the air enters through the louver assemblies, and above the drift eliminators 34. The pressure drop through the louver assemblies was evaluated using the difference in pressures recorded below the wet deck fill using the conventional louver assemblies and the louver assemblies of this invention. The pressure below the wet deck fill using the louver assemblies of this invention was greater than the pressure below the wet deck fill using the conventional louver assemblies. This would lead one to believe that the pressure measurement above the drift eliminators would also be greater for the louver assemblies of this invention than conventional louver assemblies. However, this was not the case, as the pressure measurements above the drift eliminators were essentially the same using the louver assemblies of this invention and the conventional louver assemblies. This indicates that the same amount of air, rather than a less amount of air, is being moved with the same amount of power with the louver assemblies of this invention. This in turn, indicates no lessening of overall cooling tower thermal capacity, which would have been expected in view of the greater pressure below the wet deck fill using the louver assemblies of this invention. The use of the louver assemblies of the present invention thereby produced a surprising result, in that there was no measurable loss in thermal efficiency. Thus, the use of the louver assemblies of the present invention had an unexpected effect of apparently straightening and balancing or otherwise more efficiently directing the air flow into the cooling tower, resulting in lower air flow turning losses in the region of the basin and better utilization of air flow in the zone of the cooling tower where water from the spray pipes mixes with the air passing through the cooling tower. This resulted in a surprising net equal overall energy efficiency.

The use of the louvers of the present invention provided another surprising result by reducing the sound emanating from the water splashing in the cooling tower water basin. Compared to the conventional louver assemblies, use of the louver assemblies 26*a* of the present invention reduced the sound 1 to 2 dbA in higher frequency bands, effectively reducing the overall sound levels.

The louver assemblies 26*a* of the present invention thus demonstrated a significant improvement over the conventional louver assemblies by providing better splash-out reduction, better light reduction, and better sound reduction, without adversely affecting energy consumption, material consumption and product manufacturing costs.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A louver assembly for use in a heat exchange apparatus in an ambient environment, the heat exchange apparatus being associated with a liquid basin, the louver assembly having a height and comprising a plurality of generally vertically oriented, non-corrugated sheets of material, and a plurality of generally vertically oriented corrugated sheets of material having corrugations extending across the corrugated sheet and along the corrugated sheet for the entire height of the louver assembly, each non-corrugated sheet of material being retained adjacent to a corrugated sheet of material; spaces between the corrugations and the non-corrugated sheets forming air passageways extending downwardly through the louver assembly from an inlet face of the louver assembly adjacent the ambient environment to an outlet face of the louver assembly adjacent an interior of the heat exchange apparatus; the louver assembly having a width based on the dimensions of the sheets in a direction along the inlet face and the outlet face of the louver assembly and the number of non-corrugated sheets and corrugated sheets comprising the louver assembly; the louver assembly having a depth defined by the distance from the inlet face to the outlet face of the louver assembly; the louver assembly having a generally vertical longitudinal reference plane extending through a centerline along the louver assembly's width and a generally vertical transverse reference plane extending perpendicular to the longitudinal reference plane; each sheet of material having a V-shape in a top plan view of the louver assembly, the V-shape of the non-corrugated sheets and the corrugated sheets being defined by two acute angles X and Y on one surface of the sheets with respect to the transverse reference plane and resulting in a vertex angle Z on an opposite surface of the sheets, the vertex angle Z being about 120° to about 140°; the V-shape of the sheets providing each of the corrugations and air passageways with a single inlet portion extending from the inlet face of the louver assembly to the longitudinal reference plane and a single outlet portion extending from the longitudinal reference plane to the outlet face of the louver assembly, the angle X being measured with respect to the intersection of the longitudinal and transverse reference planes regarding the inlet portion and the angle Y being measured with respect to the intersection of the longitudinal and transverse reference planes regarding the outlet portion; the inlet portion having a downwardly directed angle A1 of greater than 0° to about 10° with respect to a horizontal reference plane measured from an intersection of the inlet face and the horizontal reference plane; the outlet portion having a downwardly directed angle A2 of greater than 0° to about 10° with respect to a horizontal reference plane measured from the intersection of the inlet face and the horizontal reference plane; and each of the air passageways having a width generally parallel to the longitudinal reference plane such that there is a ratio of the depth of the louver assembly to the width of each of the air passageways of about 3:1 to about 6:1.

2. The louver assembly of claim 1, wherein the angle X is about 20° to about 30° and the angle Y is about 20° to about 30°.

3. The louver assembly of claim 2, wherein the angles X and Y are substantially equal to each other.

4. The louver assembly of claim 3, wherein each of the angles X and Y is about 25°, whereby the angle Z is about 130°.

5. The louver assembly of claim 2, wherein the angle X is greater than the angle Y.

6. The louver assembly of claim 5, wherein the angle Z is about 130°.

7. The louver assembly of claim 1 wherein the inlet portion has a depth from the inlet face to the longitudinal reference plane and the outlet portion has a depth from the longitudinal reference plane to the outlet face, and wherein the depth of the inlet portion is about equal to the depth of the outlet portion.

8. The louver assembly of claim 1 wherein the inlet portion has a depth from the inlet face to the longitudinal reference plane and the outlet portion has a depth from the longitudinal reference plane to the outlet face, and wherein the depth of the inlet portion is greater than the depth of the outlet portion.

9. The louver assembly of claim 1 wherein the inlet portion has a depth from the inlet face to the longitudinal reference plane and the outlet portion has a depth from the longitudinal reference plane to the outlet face, and wherein the depth of the outlet portion is greater than the depth of the inlet portion.

10. The louver assembly of claim 1, wherein each of the angles A1 and A2 independently is about 5° to about 10°.

11. The louver assembly of claim 10, wherein each of the angles A1 and A2 is about 10°.

12. The louver assembly of claim 4, wherein each of the angles A1 and A2 is about 10°.

13. The louver assembly of claim 6, wherein each of the angles A1 and A2 is about 10°.

14. The louver assembly of claim 7, wherein the depth of the louver assembly is about 1.75 inches (4.4 cm) to about 8.25 inches (21.0 cm).

15. The louver assembly of claim 14, wherein the depth of the louver assembly is about 2.8 inches (7.1 cm) to about 3.6 inches (9.1 cm).

16. The louver assembly of claim 12, wherein the depth of the louver assembly is about 3.2 inches (8.1 cm).

17. The louver assembly of claim 1, wherein the width of an air passageway is about 0.5 inch (1.3 cm) to about 1.5 inches (3.8 cm).

18. The louver assembly of claim 17, wherein the width of an air passageway is about 0.65 inch (1.7 cm) to about 1.0 inch (2.5 cm).

19. The louver assembly of claim 18, wherein the width of an air passageway is about 0.75 inch (1.9 cm).

20. The louver assembly of claim 1, wherein the ratio of the depth of the louver assembly to the width of each of the air passageways is about 3.5:1 to about 5.5:1.

21. The louver assembly of claim 20, wherein the ratio of the depth of the louver assembly to the width of each of the air passageways is about 4.3:1.

22. The louver assembly of claim 1, wherein the angle X is about 20° to about 30°, the angle Y is about 20° to about 30° and the angle X is substantially equal to or greater than the angle Y, wherein each of the angles A1 and A2 is about 5° to about 10°, wherein the depth of the louver assembly is about 1.75 inches (4.4 cm) to about 8.25 inches (21.0 cm), and wherein the width of an air passageway is about 0.5 inch (1.3 cm) to about 1.5 inches (3.8 cm).

23. The louver assembly of claim 22, wherein the angle X is about 20° to about 30°, the angle Y is about 20° to about 30° and angles X and Y are substantially equal, wherein each of the angles A1 and A2 is about 5° to about 10°, wherein the depth of the louver assembly is about 2.8 inches (7.1 cm) to about 3.6 inches (9.1 cm), wherein the width of an air passageway is about 0.65 inch (1.7 cm) to about 1.0 inch (2.5 cm), and wherein the ratio of the depth of the louver assembly to the width of each of the air passageways is about 3.5:1 to about 5.5:1.

24. The louver assembly of claim 23, wherein each of the angles X and Y is about 25° and the angle Z is about 130°, wherein each of the angles A1 and A2 is about 10°, wherein the depth of the louver assembly is about 3.2 inches (8.1 cm), wherein the width of an air passageway is about 0.75 inch (1.9 cm), and wherein the ratio of the depth of the louver assembly to the width of each of the air-passageways is about 4.3:1.

25. The louver assembly of claim 1, wherein the corrugations comprise adjacent peaks and valleys, and the peaks of one corrugated sheet are 180° out of phase with the peaks of an adjacent corrugated sheet, such that the peaks of one corrugated sheet are aligned with the valleys of adjacent corrugated sheets.

26. The louver assembly of claim 1, wherein the corrugations comprise adjacent peaks and valleys, and the peaks of one corrugated sheet are in phase with the peaks of an adjacent corrugated sheet, such that the peaks of one corrugated sheet are aligned with the peaks of adjacent corrugated sheets and the valleys of one corrugated sheet are aligned with the valleys of adjacent corrugated sheets.

* * * * *